US010843914B1

(12) United States Patent
Weatherly

(10) Patent No.: US 10,843,914 B1
(45) Date of Patent: Nov. 24, 2020

(54) PUMP BOTTLE ACCESS DEVICE

(71) Applicant: Dan Weatherly, Hot Springs, AR (US)

(72) Inventor: Dan Weatherly, Hot Springs, AR (US)

( * ) Notice: Subject to any disclaimer, the term of this patent is extended or adjusted under 35 U.S.C. 154(b) by 0 days.

(21) Appl. No.: 16/786,235

(22) Filed: Feb. 10, 2020

Related U.S. Application Data

(60) Provisional application No. 62/846,009, filed on May 10, 2019.

(51) Int. Cl.
*B67B 7/00* (2006.01)
*B65D 83/00* (2006.01)

(52) U.S. Cl.
CPC ..... *B67B 7/24* (2013.01); *B65D 83/00* (2013.01); *B65D 2231/025* (2013.01)

(58) Field of Classification Search
CPC ..... F16B 25/0078; F16B 25/10; B65D 83/00; B65D 2231/025; B67D 7/24; B67D 7/26; Y10R 137/0463; Y10R 137/0469; Y10R 137/6123
USPC ..... 222/81, 87, 91, 331
See application file for complete search history.

(56) References Cited

U.S. PATENT DOCUMENTS 537,755 A * 4/1895 Crozier ..... 222/91
690,223 A * 12/1901 Antill ..... 222/91
1,618,720 A * 2/1927 Moore ..... B67B 7/26 222/91
2,013,361 A * 9/1935 Reynolds ..... B67B 7/26 222/90
2,184,263 A * 12/1939 Adler ..... B67B 7/26 222/91
2,414,911 A * 1/1947 Temple ..... 222/81
2,622,767 A * 12/1952 Kovalik ..... F02M 25/14 222/83.5
2,746,379 A * 5/1956 Covington ..... A47J 19/02 100/108
2,925,199 A * 2/1960 Brookshier ..... B65D 5/60 222/91
3,278,083 A * 10/1966 Serafini ..... B67B 7/26 222/91
3,768,698 A * 10/1973 Corty, Sr. ..... B67B 7/26 222/91
3,973,698 A * 8/1976 Kato ..... B67B 7/26 222/91
4,712,714 A * 12/1987 Mucciarone ..... B67B 7/26 222/91

(Continued)

FOREIGN PATENT DOCUMENTS

KR 20120094631 8/2012
KR 20120007187 10/2012
KR 20130002854 5/2013

*Primary Examiner* — Benjamin R Shaw
(74) *Attorney, Agent, or Firm* — Head, Johnson, Kachigian & Wilkinson, PC

(57) ABSTRACT

A bottle access device comprising a body, a central bore extending partway through the body from a first end, and one or more radial bores extending radially from the central bore through the side of the body. The bores may form a path from outside the body, through the radial bores, through the central bore, and out the first end. The device may be inserted through the wall of a plastic bottle, allowing access to product within the bottle via the bores by squeezing the bottle. The body may be threaded and the second end of the body may be pointed, allowing the device to act as a self-tapping screw for insertion into the wall of the bottle.

10 Claims, 3 Drawing Sheets

(56) References Cited

U.S. PATENT DOCUMENTS

| | | | | |
|---|---|---|---|---|
| 4,867,324 | A * | 9/1989 | Rogosich | A61J 11/0095 215/11.1 |
| 5,427,343 | A | 6/1995 | Ferris | |
| 5,704,383 | A * | 1/1998 | Kammeraad | B09B 3/0058 123/196 A |
| 6,223,940 | B1 * | 5/2001 | Quinn | B65D 75/5877 222/81 |
| 10,189,040 | B2 | 1/2019 | Vecchione | |
| 2006/0102654 | A1 | 5/2006 | Seys et al. | |
| 2008/0302831 | A1 | 12/2008 | Wang | |
| 2009/0242588 | A1 | 10/2009 | Olson | |
| 2011/0031273 | A1 * | 2/2011 | Macler | B67B 7/24 222/81 |
| 2013/0284764 | A1 | 10/2013 | Baxter-Waller | |
| 2014/0144937 | A1 * | 5/2014 | Arsena-Armstrong | B67B 7/26 222/89 |

* cited by examiner

PUMP BOTTLE ACCESS DEVICE

CROSS REFERENCE

This application is based on and claims priority to U.S. Provisional Application No. 62/846,009 filed May 10, 2019.

BACKGROUND OF THE INVENTION

Field of the Invention

This invention relates generally, but not by way of limitation, to a device for accessing leftover product in the bottom of a bottle.

Description of the Related Art

Pump bottles offer a convenient way of accessing product stored within the bottle. Pump bottles are often used for lotion, hand soap, body or face wash, hair care products, etc. Standard pump bottles, however, almost always fail to dispense all of the product in the bottle. Typically, the pump mechanism at the top of the bottle is connected to a tube extending to the bottom of the bottle, through which the product in the bottle is conveyed. The tube is often too short to reach the bottom of the bottle, however, leaving a layer of product that cannot be reached by the pump. Even with a longer tube, product at the bottom of the bottle along the edges, where the tube cannot reach, is often left behind. A user of a standard pump bottle then must either remove the pump mechanism and attempt to shake the remaining product from the bottom of the bottle to the opening at the top or must throw away the remaining product.

A similar problem occurs with squeezable bottles without pumps, but which contain highly viscous product, such as the aforementioned lotion, hand soap, body or face wash, hair care products, and other personal care products, as well as condiments like ketchup, mustard, salad dressing, jelly, etc. and other products. It can be difficult for the user to get the last of the product out of the bottle, often requiring shaking, waiting for the product to slowly travel from the bottom of the bottle to the opening at the top, diluting the product to make it less viscous, or giving up and throwing away the remaining product.

Based on the foregoing, it is desirable to provide a device that can be used at the bottom of a bottle to access the contents thereof.

It is further desirable for the device to allow leftover product to be simply squeezed out of the bottle via the device.

It is further desirable for the device to be easily attached to the bottle, either by screwing or pushing.

It is further desirable for the device to be removable and reusable.

SUMMARY OF THE INVENTION

In general, in a first aspect, the invention relates to a bottle access device comprising: a body with a first end and a second end; a central bore extending partway through the body from the first end toward but not reaching the second end; and one or more radial bores extending radially from the central bore such that the radial bores are capable of providing a path from outside the body, through the radial bores, through the central bore, and out the first end.

The first end may comprise a flange, the second end may be pointed, and/or the body may be threaded. If all three are true, the device may be capable of acting as a self-tapping screw. The device may further comprise a socket in the first end, where the central bore extends through the socket and where the socket has a non-circular cross section. The device may further comprise a tool, where the tool is receivable in the socket and capable of rotating the body by rotating the tool.

The radial bores may be perpendicular to a long axis of the body. The radial bores may be located nearer the first end than the second end.

The device may be receivable through a wall of a bottle. The device may be removable from the wall of the bottle when no longer in use.

Figure 1:
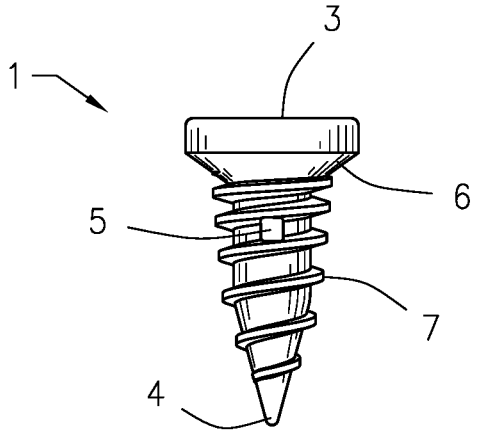
FIG. 1 is a side view of the device.
Figure 2:
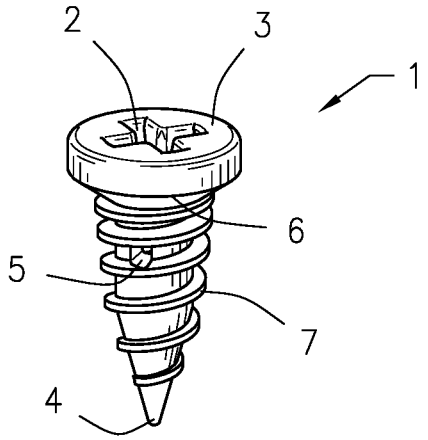
FIG. 2 is a perspective view of the device, showing the first end.
Figure 3:
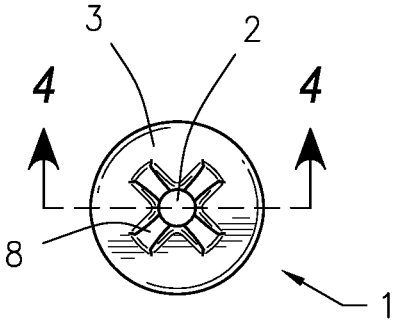
FIG. 3 is a view of the first end of the device.
Figure 4:
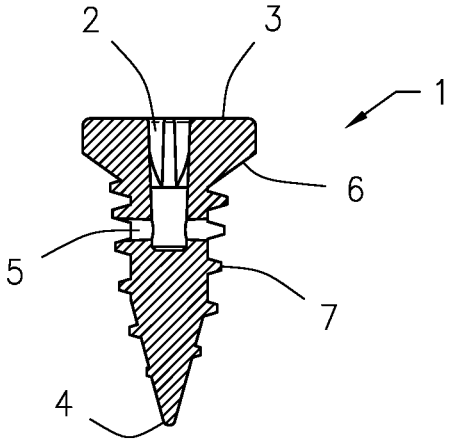
FIG. 4 is a side cross-sectional view of the device.
Figure 5:
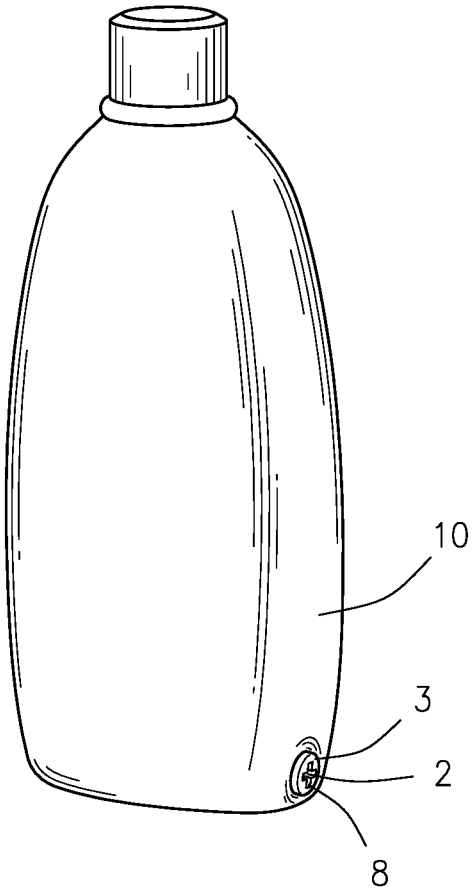
FIG. 5 is a perspective view of the device in place in a bottle, showing the first end.
Figure 6:
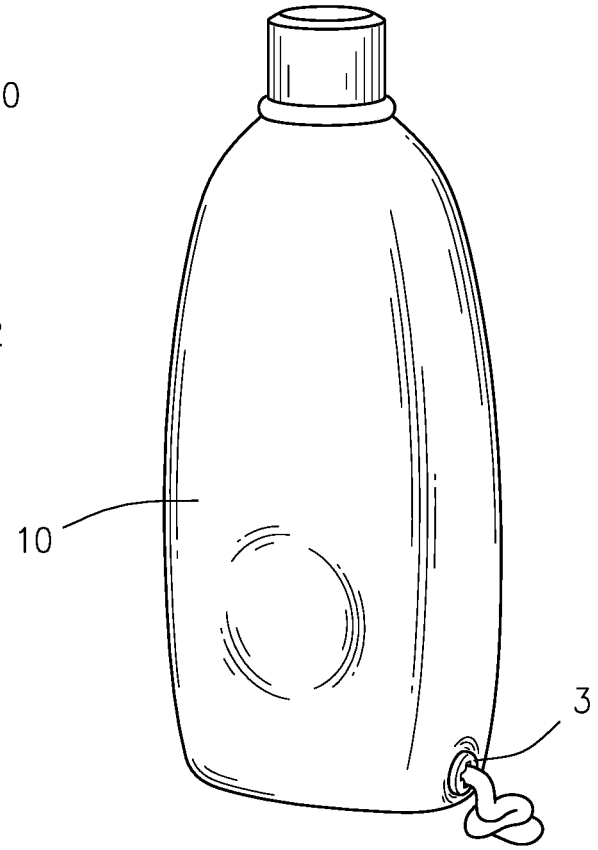
FIG. 6 is a perspective view of the device in use.
Figure 7:
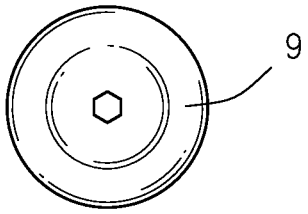
FIG. 7 is a top view of the tool.
Figure 8:
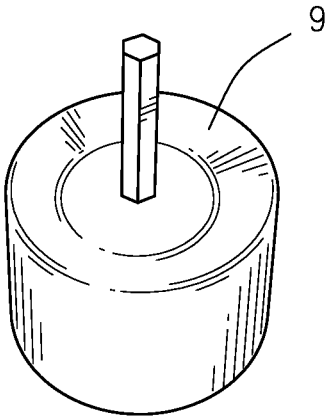
FIG. 8 is a perspective view of the tool.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a pump bottle access device. The device may be used in conjunction with a bottle 10. The bottle 10 may be any desired bottle. In particular, the bottle 10 may be a plastic bottle 10 and/or a soft-sided bottle 10. The device may have a generally elongate body 1 with a central bore 2 extending partway through the body 1 along its long axis. The body 1 may have a first end 3 that is open to the central bore 2 and a second end 4 that is not open to the central bore 2. The body 1 may have one or more radial bores 5 connecting to the central bore 2 and extending radially outward through the side of the body 1, providing radial access from outside the body 1 to the central bore 2.

The first end 3 may be generally flat, as shown, or curved as desired. As noted above, the first end 3 may be open to the central bore 2. The first end 3 may flare outward, as shown, similar to a typical screw or nail head. This flare may form a flange 6 that may act as a stop when the device is inserted into the bottle 10 and may provide a surface to grip to remove the device from the bottle 10 when it is no longer needed.

The second end 4 may be generally pointed, as shown, or the second end 4 may be flat or any other shape as desired. If the second end 4 is pointed, it may allow the device to be inserted into a bottle without the need to first make a hole in the bottle 10. Rather, the device may be pushed or screwed into the bottle 10 with the pointed second end 4 making a hole as it is pushed or screwed in. As noted above, the second end 4 may not be open to the central bore 2. Rather, the central bore 2 may terminate within the body 1 before reaching the second end 4.

The exterior of the body 1 may be threaded. Threads 7 may extend outward from the body 1, as is typical of screws or other threaded bodies. When the threads 7 are present in conjunction with a pointed second end 4, the device may act as a self-tapping screw when inserted into a bottle 10.

The central bore 2 may extend to any desired depth within the body 1, so long as it does not extend through the second end 4. The central bore 2 may have a generally circular cross section, or may have a cross section that is any other desired shape. In particular, at the first end 3, the central bore 2 may widen into a socket 8, which may have a non-circular cross section. A tool 9 may be receivable in the socket 8, allowing use of the tool 9 to rotate the device and screw it into the bottle 10 when the body 1 has threads 7. The tool 9 may have a similar cross section to that of the socket 8, such that the tool 9 may fit within the socket 8 but may not rotate within the socket 8 without rotating the device. For example, the socket 8 may have a hexagonal cross section and the tool 9 may be a hex key or allen wrench.

The one or more radial bores 5 may form a passage from the central bore 2 to the exterior of the body 1. The radial bores 5 may be perpendicular to the long axis of the body 1, or may be at an angle thereto, as desired. The interior end of the radial bores 5 may be located closer to the first end 3 than the terminus of the central bore 2, such that the radial bores 5 connect with the central bore 2. The radial bores 5 may be open to the central bore 2 on one end and open to the exterior of the body 1 on the second end. The exterior end of the radial bores 5 may be located near the first end 3, but not directly adjacent the flange 6. Thus, when in use, there may be room for the wall of the bottle 10 between the flange 6 and the radial bores 5, allowing the radial bores 5 to be located inside the bottle 10 and near the wall of the bottle 10, rather than partially within and partially without the bottle 10 or blocked by the wall of the bottle 10, as may be the case if the radial bores 5 are located too close to the flange 6. While the radial bores 5 may be spaced from the flange 6 sufficiently to provide room for the wall of the bottle 10 therebetween, the radial bores 5 may not be spaced too far from the flange 6, as the closer the radial bores 5 are to the wall, the less wasted product may be left behind within the bottle 10.

The device may be removable from the bottle 10 and may be reusable in multiple bottles 10, as desired.

During use, a user may insert the device through the wall of a bottle 10 near the bottom of the bottle 10, where remaining product is located. The user may ensure that the flange 6 is directly adjacent the wall of the bottle 10, which in turn ensures that the radial bores 5 are located inside the bottle 10, past the wall of the bottle 10. The user may then squeeze the bottle, which may force the product through the radial bores 5, into the central bore 2, and then out of the central bore 2 via the first end 3.

If the body 1 is threaded and the second end 4 is pointed such that the device may act as a self-tapping screw, the user may insert the device through the wall of the bottle 10 by directly screwing the device into the wall. This may be aided by use of the tool 9, if applicable. Similarly, if the body 1 is not threaded but the second end 4 is sufficiently pointed, the device may be pushed directly into the wall of the bottle 10 by force. Alternately, if the wall of the bottle 10 is too thick or if the second end 4 is flat, rounded, or otherwise insufficiently pointed, the user may cut, drill, or otherwise make a hole in the wall of a bottle 10 before inserting the device. The user may then place the device in the hole. In all cases, the user may continue pushing or screwing the device into the wall of the bottle 10 until the flange 6 is directly adjacent the wall of the bottle 10 to ensure proper placement of the radial bores 5 within the bottle.

After use, the device may be removed from the bottle 10 by grasping the flange 6 and pulling the device out, if the body 1 is not threaded, or by unscrewing the device either with or without the use of the tool 9, as desired, if the body 1 is threaded. The device may then be washed, if necessary, and reused in a different bottle 10, if desired.

Whereas, the devices and methods have been described in relation to the drawings and claims, it should be understood that other and further modifications, apart from those shown or suggested herein, may be made within the spirit and scope of this invention.

What is claimed is:

1. A bottle access device comprising:

a body with a first end and a second end;

a central bore extending partway through the body from the first end toward but not reaching the second end;

a socket in the first end, where the central bore extends through the socket and where the socket has a non-circular cross section; and one or more radial bores extending radially from the central bore such that the radial bores are capable of providing a path from outside the body, through the radial bores, through the central bore, and out the first end.

2. The bottle access device of claim 1 where the first end comprises a flange.

3. The bottle access device of claim 1 where the second end is pointed.

4. The bottle access device of claim 1 where the body is threaded.

5. The bottle access device of claim 1 where:

the first end comprises a flange;

the second end is pointed; and the body is threaded, such that the device is capable of acting as a self-tapping screw.

6. The bottle access device of claim 1 further comprising a tool, where the tool is receivable in the socket and capable of rotating the body by rotating the tool.

7. The bottle access device of claim 1 where the radial bores are perpendicular to a long axis of the body.

8. The bottle access device of claim 1 where the radial bores are located nearer the first end than the second end.

9. The bottle access device of claim 1 where the device is receivable through a wall of a bottle.

10. The bottle access device of claim 9 where the device is removable from the wall of the bottle.

* * * * *